US009109169B2

(12) United States Patent
Al-Therwi et al.

(10) Patent No.: US 9,109,169 B2
(45) Date of Patent: Aug. 18, 2015

(54) MAXIMIZING AROMATICS PRODUCTION FROM HYDROCRACKED NAPHTHA

(71) Applicant: Saudi Arabian Oil Company, Dhahran (SA)

(72) Inventors: Fahad Al-Therwi, Yanbu (SA); Noaman Al-Fudail, Dammam (SA); Mansoor Aleidi, Alkhobar (SA)

(73) Assignee: Saudi Arabian Oil Company, Dhahran (SA)

( * ) Notice: Subject to any disclaimer, the term of this patent is extended or adjusted under 35 U.S.C. 154(b) by 169 days.

(21) Appl. No.: 13/875,506

(22) Filed: May 2, 2013

(65) Prior Publication Data

US 2013/0291432 A1 Nov. 7, 2013

Related U.S. Application Data

(60) Provisional application No. 61/641,507, filed on May 2, 2012.

(51) Int. Cl.
*C10G 35/04* (2006.01)
*C10G 59/00* (2006.01)
(Continued)

(52) U.S. Cl.
CPC ..... *C10G 35/04* (2013.01); *C10G 59/00* (2013.01); *C10G 69/10* (2013.01); *C10L 1/06* (2013.01); *C10G 2400/30* (2013.01)

(58) Field of Classification Search
CPC ..... C10G 35/04; C10G 59/00; C10G 69/10; C10G 2400/30; C10L 1/06
See application file for complete search history.

(56) References Cited

U.S. PATENT DOCUMENTS 3,649,520 A 3/1972 Graven
3,702,292 A 11/1972 Burich
(Continued)

FOREIGN PATENT DOCUMENTS

CN 101376823 A 3/2009
CN 102037102 A 4/2011
(Continued)

OTHER PUBLICATIONS

Hu et al., "Molecular modeling and optimization for catalytic reforming", Chemical Engineering Communications, 2004, p. 1.
(Continued)

*Primary Examiner* — Cephia D Toomer
(74) *Attorney, Agent, or Firm* — Bracewell & Giuliani LLP; Constance Gall Rhebergen

(57) ABSTRACT

A gasoline blending components production system useful for producing both aromatics and gasoline blending components from naphtha. The production system includes a light hydrocracked naphtha splitter, a medium hydrocracked naphtha splitter, a naphtha hydrotreater, an isomerization unit, a continuous catalytic reformer and aromatics complex. The production system is operable to produce both refined benzene and para-xylene products in addition to medium hydrocracked naphtha, isomerate, a C7s cut and a C9+ cut, which are useful for gasoline blending without additional treatment. A method for producing gasoline blending components while maximizing aromatic production includes introducing both stabilized hydrocracked naphtha to the light hydrocracked naphtha splitter and straight run naphtha to the naphtha hydrotreater. Operating the production system produces three types of hydrocracked naphtha: a light hydrocracked naphtha, a medium hydrocracked naphtha and a heavy hydrocracked naphtha. Light and heavy hydrocracked naphtha are directed to the naphtha hydrotreater.

15 Claims, 1 Drawing Sheet

(51) Int. Cl.
*C10G 69/10* (2006.01)
*C10L 1/06* (2006.01)

(56) References Cited

U.S. PATENT DOCUMENTS

| | | | | |
|---|---|---|---|---|
| 3,933,619 | A | 1/1976 | Kozlowski | |
| 4,222,854 | A | 9/1980 | Vorhis, Jr. et al. | |
| 4,747,933 | A | 5/1988 | Hibbs | |
| 4,923,589 | A | 5/1990 | Dalson | |
| 6,281,398 | B1 | 8/2001 | Belloir et al. | |
| 6,787,025 | B2 * | 9/2004 | Mukherjee et al. | 208/89 |
| 6,793,804 | B1 * | 9/2004 | Lindsay et al. | 208/210 |
| 7,507,325 | B2 | 3/2009 | Gueret et al. | |

FOREIGN PATENT DOCUMENTS

| | | | |
|---|---|---|---|
| EP | 0284228 | B1 | 1/1992 |
| GB | 1404776 | A | 9/1975 |
| GB | 2034351 | A | 6/1980 |
| JP | 3639243 | B2 | 4/2005 |
| WO | 9617039 | A1 | 6/1996 |
| WO | 99/23192 | A1 | 5/1999 |

OTHER PUBLICATIONS

Coco et al., "Multidimensional gas chromatographic determination of paraffins, olefins and aromatics in naphthas", Annali Di Chimica, EUCHEM 2006 Conference, Rimini Italy, 2006, p. 1.

Viswanadham et al., "Reformulation of FCC gasoline" Fuel, Mexican Congress on Chemical Reaction Engineering, Mexico City, Mexico Inst. Mexicano Petroleo, Jun. 2007, p. 1.

Liu et al., "A scenario-based clean gasoline production strategy for china national petroleum corporation", Petroleum Science, 2008, p. 1.

Nafis et al., "Recovering Intermediate-Range FCC Naphtha", Handbook of Petroleum Refining Processes Third Edition, 2004, pp. 11.72-11.78, McGraw Hill, USA.

PCT International Search Report and the Written Opinion of the International Searching Authority dated Nov. 28, 2013; International Application No. PCT/US2012/039191; International File Date: May 2, 2012.

PCT Notification of Transmittal of the Partial International Search Report of the International Searching Authority, dated Jul. 4, 2013; International Application No. PCT/US2013/039191; International File Date: May 2, 2013.

* cited by examiner

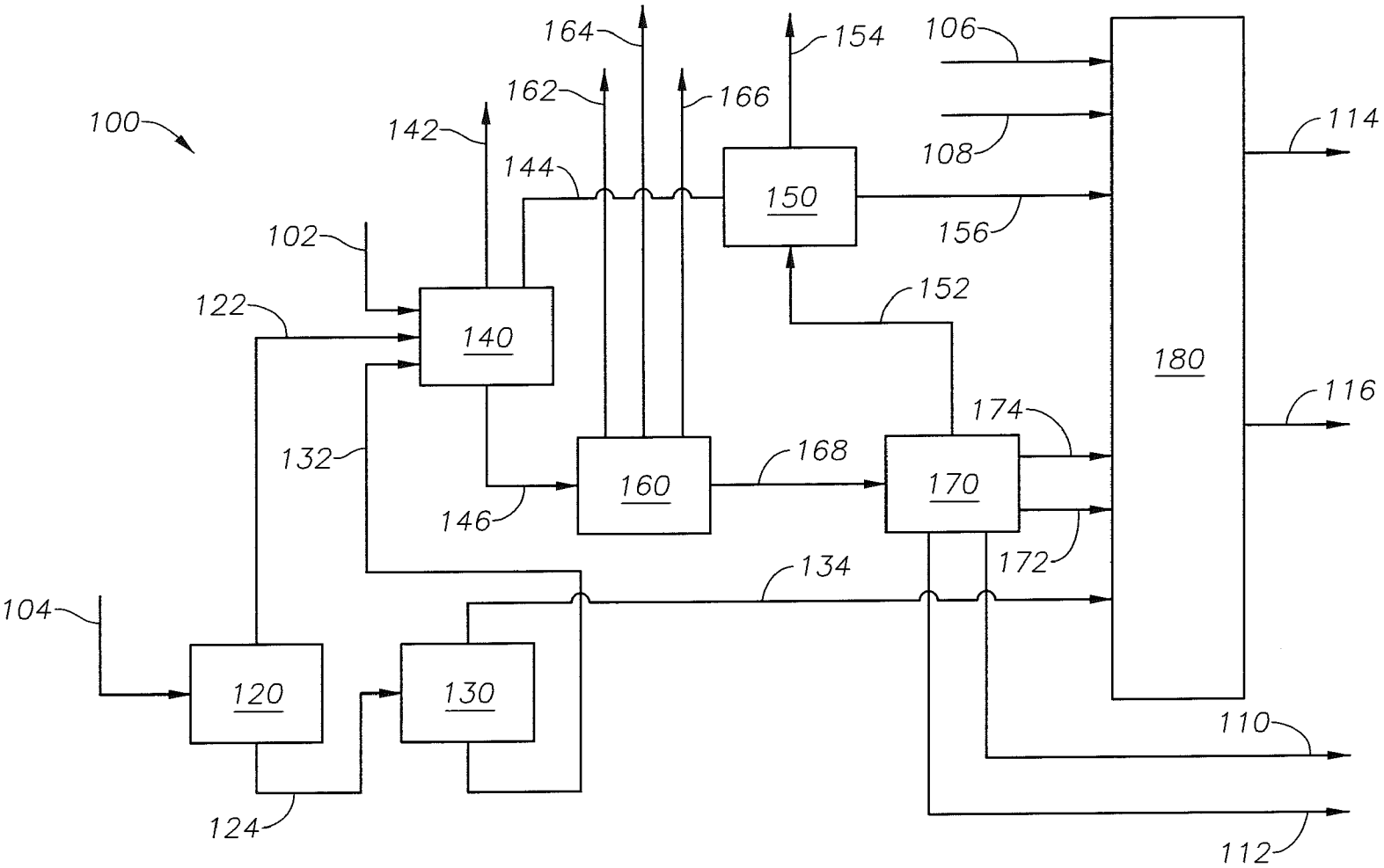
100
102
104
106
108
110
112
114
116
120
122
124
130
132
134
140
142
144
146
150
152
154
156
160
162
164
166
168
170
172
174
180

MAXIMIZING AROMATICS PRODUCTION FROM HYDROCRACKED NAPHTHA

CROSS-REFERENCE TO RELATED PATENT APPLICATIONS

This application claims priority from U.S. Provisional Application No. 61/641,507, filed May 2, 2012. For purposes of United States patent practice, this application incorporates the contents of the Provisional Application by reference in its entirety.

BACKGROUND OF THE INVENTION

1. Field of the Invention

The field of invention relates to the production of aromatics from naphtha. More specifically, the field relates to a system and method for maximizing aromatic product production while satisfying gasoline production demand using straight run and hydrocracked naphtha.

2. Description of the Related Art

Two major sources of naphtha for both direct gasoline blending and the production of gasoline blending components are straight run naphtha and hydrocracked naphtha. Straight run naphtha is the atmospheric distillation oil cut from the crude distillation column. Hydrocracked naphtha is one of several products from a hydrocracking unit. A hydrocracking unit takes feeds, including cat cracker "cycle oil", visbreaker gas oils and coker unit gas oils, and breaks down the long-chain paraffins and aromatics, especially the heavy aromatic, polynuclear aromatic and heteroaromatic fractions in the oils, into smaller paraffins and aromatics. The hydrocracker produces several streams, including a naphtha stream that contains lower molecular weight normal and cyclo-paraffins, olefins and aromatics with shorter alkyl chain moieties.

Crude oil refiners extract aromatics, especially BTEXs (benzene, toluene, ethyl benzene and the xylenes), as petrochemical feedstocks. Environmental regulations on fuels are promoting the reduction or outright elimination of C6-8 aromatics in gasoline.

Traditional gasoline blending component production systems separate hydrocracked naphtha into light and heavy naphtha fractions for use not only in forming gasoline-blending components but also for direct blending into gasoline fuels. Light hydrocracked naphtha includes paraffins and olefins with lesser amounts of naphthenes and aromatics. Isoparaffins and aromatics suitable for gasoline blending form after separation, isomerization or reformation of the light hydrocracked naphtha. Heavy hydrocracked naphtha includes aromatics with a portion of heavier paraffins and mono- and di-olefins. Refiners direct a portion of the heavy hydrocracked naphtha to the gasoline blending "pool", which are storage tanks that the gasoline blending facility uses to mix gasoline blending components to make regular and premium grades of motor fuel. Heavy hydrocracked naphtha boosts the research octane number (RON) of the blended fuel because of its aromatic content. Refiners direct the remainder of the heavy hydrocracked naphtha to reforming and aromatics separations units to create valuable refined aromatic products.

Traditional gasoline blending component production systems do not maximize the potential for capturing aromatics from the heavy portions of the hydrocracked naphtha. Aromatics are valuable commodity chemicals for specialized chemical and polymer production. Gasoline blending operations do require a volume of hydrocracked naphtha for creating suitable amounts of products at an appropriate RON value.

SUMMARY OF THE INVENTION

A gasoline blending components production system is useful for producing both aromatics and gasoline blending components from naphtha. The production system includes a light hydrocracked naphtha splitter. The light naphtha splitter is operable to receive stabilized hydrocracked naphtha and to produce light hydrocracked naphtha and light hydrocracked naphtha splitter bottoms from the stabilized hydrocracked naphtha. The production system includes a medium hydrocracked naphtha splitter. The medium hydrocracked naphtha splitter couples to the light hydrocracked naphtha splitter and is operable to receive the light hydrocracked naphtha splitter bottoms. It is also operable to produce both a medium hydrocracked naphtha product and a heavy hydrocracked naphtha from the introduced light hydrocracked naphtha splitter bottoms. The production system includes a naphtha hydrotreater (NHT). The NHT couples to both the light hydrocracked naphtha splitter and the medium hydrocracked naphtha splitter. The NHT is operable to receive straight run naphtha, the light hydrocracked naphtha and the heavy hydrocracked naphtha. The NHT produces a sweetened light hydrotreated naphtha and a sweetened heavy hydrotreated naphtha from the introduced naphthas. The production system includes an isomerization unit. The isomerization unit couples to both the NHT and an aromatics complex. The isomerization unit produces an isomerate product from the received sweetened light hydrotreated naphtha and a raffinate. The production system includes a continuous catalytic reformer (CCR). The CCR couples to the naphtha hydrotreater and is operable to produce a reformate produced from the received sweetened heavy hydrotreated naphtha. The production system includes the aromatics complex. The aromatics complex couples to the CCR and is operable to produce a refined benzene product, a refined para-xylene product, a C7s cut product, a C9+ cut product and the raffinate. The medium hydrocracked naphtha, the isomerate, the C7s cut, and the C9+ cut products are useful as gasoline blending components without additional treatment.

A method for producing gasoline blending components while maximizing aromatic production includes the steps of introducing stabilized hydrocracked naphtha to the light hydrocracked naphtha splitter and introducing straight run naphtha to the NHT of the gasoline blending components production system. The method of producing components also includes the steps of operating the production system such that the light hydrocracked naphtha splitter forms both a light hydrocracked naphtha and a light hydrocracked naphtha splitter bottoms from the stabilized hydrocracked naphtha. The method also includes the steps of introducing the light hydrocracked naphtha into the NHT and the light hydrocracked naphtha splitter bottoms into a medium hydrocracked naphtha splitter. The method also includes the step of operating the medium hydrocracked naphtha splitter to form both a medium hydrocracked naphtha product and a heavy hydrocracked naphtha from the light hydrocracked naphtha splitter bottoms. The method also includes the step of introducing the heavy hydrocracked naphtha into the NHT. The method also includes the step of forming an isomerate, a benzene, a para-xylene, a C7s cut and a C9+ cut products from the introduced straight run naphtha, the light hydrocracked naphtha and the heavy hydrocracked naphtha.

A method for manufacturing a gasoline fuel composition includes the step of introducing both stabilized hydrocracked naphtha and straight run naphtha to a gasoline blending components production system. The method includes operating the production system to produce a medium hydrocracked naphtha, an isomerate, a benzene, a para-xylene, a C7s cut and a C9+ cut products from the introduced stabilized hydrocracked naphtha and straight run naphtha. The method includes blending proportional amounts of the medium hydrocracked naphtha product, the isomerate product, the C7s cut product and the C9+ cut product with a proportional amount of normal butane and a proportional amount of methyl tert-butyl ether to form the gasoline fuel composition. The gasoline fuel composition has a Research Octane Number in a range of from about 91 to about 95. The medium hydrocracked naphtha product includes paraffins, aromatics and naphthenes having a carbon count between 5 and 8. The medium hydrocracked naphtha has significant amounts of each of C6 and C7 paraffins and C6 and C7 naphthalene by weight. The medium hydrocracked naphtha is substantially free of each of C5 paraffins and C5 and C8 naphthenes by weight. The medium hydrocracked naphtha does not contain greater than a detectable amount of C8 aromatics by weight.

The gasoline blending component production system is operable to separate hydrocracked naphtha feed into three intermediates—the light hydrocracked naphtha, the medium hydrocracked naphtha and the heavy hydrocracked naphtha. The system maximizes aromatics production from the hydrocracked naphtha by using the intermediates with the highest aromatic and alkyl aromatic content for aromatics production. The system also supports gasoline fuel production by utilizing the portion of the hydrocracked naphtha—the middle cut—that imparts a volume of material suitable to form gasoline fuels with appropriate RON values while simultaneously maximizing separately aromatics production.

The gasoline blending component production system directs light hydrocracked naphtha to isomerization and reformation for its olefins and paraffin content. The system directs heavy hydrocracked naphtha along the same flow pathway as the light hydrocracked naphtha such that the alkyl aromatics are processed into fuel components, benzene or para-xylene products.

Routing the middle hydrocracked naphtha cut to gasoline blending eliminates the costly choice of bluntly apportioning the traditional heavy hydrocracked naphtha cut between the gasoline blending facility and aromatics production. Instead, the gasoline blending component production system routes the aromatic-rich cut to aromatics production systems by default. This reduces the amount of aromatics sent to gasoline blending and improves the environmental quality of the gasoline fuel product. It also increases the produced volume of benzene and para-xylene, adding to the downstream chain value of the introduced naphthas.

BRIEF DESCRIPTION OF THE DRAWINGS

These and other features, aspects, and advantages of the present invention are better understood with regard to the following Detailed Description of the Preferred Embodiments, appended Claims, and accompanying Figures, where:

FIG. 1 shows a general process flow diagram for an embodiment of a gasoline blending component production system.

DETAILED DESCRIPTION OF THE PREFERRED EMBODIMENTS

The Specification, which includes the Summary of Invention, Brief Description of the Drawings and the Detailed Description of the Preferred Embodiments, and the appended Claims refer to particular features (including process or method steps) of the invention. Those of skill in the art understand that the invention includes all possible combinations and uses of particular features described in the Specification. Those of skill in the art understand that the invention is not limited to or by the description of embodiments given in the Specification. The inventive subject matter is not restricted except only in the spirit of the Specification and appended Claims.

Those of skill in the art also understand that the terminology used for describing particular embodiments does not limit the scope or breadth of the invention. In interpreting the Specification and appended Claims, all terms should be interpreted in the broadest possible manner consistent with the context of each term. All technical and scientific terms used in the Specification and appended Claims have the same meaning as commonly understood by one of ordinary skill in the art to which this invention belongs unless defined otherwise. "Paraffin" means linear and branched alkanes whereas "naphthenes" refers to cyclic and polycyclic alkanes.

As used in the Specification and appended Claims, the singular forms "a", "an", and "the" include plural references unless the context clearly indicates otherwise. The verb "comprises" and its conjugated forms should be interpreted as referring to elements, components or steps in a non-exclusive manner. The referenced elements, components or steps may be present, utilized or combined with other elements, components or steps not expressly referenced. The verb "couple" and its conjugated forms means to complete any type of required junction, including electrical, mechanical or fluid, to form a singular object from two or more previously non-joined objects. If a first device couples to a second device, the connection can occur either directly or through a common connector. "Operable" and its various forms means fit for its proper functioning and able to be used for its intended use.

Spatial terms describe the relative position of an object or a group of objects relative to another object or group of objects. The spatial relationships apply along vertical and horizontal axes. Orientation and relational words including "upstream" and "downstream" and other like terms are for descriptive convenience and are not limiting unless otherwise indicated.

Where the Specification or the appended Claims provide a range of values, it is understood that the interval encompasses each intervening value between the upper limit and the lower limit as well as the upper limit and the lower limit. The invention encompasses and bounds smaller ranges of the interval subject to any specific exclusion provided. "Substantially free" means less than 1% by the indicated unit of measure. "Significant" means equal to or greater than 10% by the indicated unit of measure. "Detectable amount" means 0.01% by the indicated unit of measure.

Where the Specification and appended Claims reference a method comprising two or more defined steps, the defined steps can be carried out in any order or simultaneously except where the context excludes that possibility.

FIG. 1

FIG. 1 shows a general process flow diagram for an embodiment of the gasoline blending component production system. FIG. 1 and its description facilitate a better understanding of the gasoline blending component production system, method of use, subsystems and product compositions. In no way should FIG. 1 limit or define the scope of the invention. FIG. 1 is a simple diagram for ease of description.

Gasoline blending component production system 100 utilizes two forms of naphtha—straight run naphtha and stabilized hydrocracked naphtha—to form blends of gasoline and refined aromatic products. Production system 100 introduces straight run naphtha from a crude distillation unit outside of process 100 using straight naphtha line 102. Production system 100 introduces stabilized hydrocracked naphtha from a hydrocracking unit outside of the process using hydrocracked naphtha line 104. Production system 100 also uses normal butane and meth tert-butyl ether (MTBE) from exterior sources for gasoline blending. Production system 100 introduces the n-butane using normal butane line 106, and introduces the MTBE using MTBE line 108.

Gasoline blending component production system 100 produces several useful products. Production system 100 passes a refined benzene product using benzene product line 110. Production system 100 also passes a refined para-xylene product using para-xylene product line 112. Production system 100 is also operable to produce two types of gasoline products. Production system 100 passes regular (91 RON) gasoline through regular gasoline line 114 and premium (95 RON) gasoline through premium gasoline line 116.

Portions of production system 100 receive and produce minor light hydrocarbon and hydrogen-bearing streams, for example, purified hydrogen, hydrogen-rich gas, sour off-gas, fuel gas and LPG, as part of the overall process of forming intermediaries, gasolines and refined aromatics.

Gasoline blending component production system 100 introduces stabilized hydrocracked naphtha to light hydrocracked naphtha splitter 120 using hydrocracked naphtha line 104. Light hydrocracked naphtha splitter 120 is operable to form light hydrocracked naphtha and a light hydrocracked naphtha splitter bottoms from the introduced stabilized hydrocracked naphtha. The light hydrocracked naphtha splitter bottoms contains a majority of the stabilized hydrocracked naphtha.

Light hydrocracked naphtha splitter bottoms line 124 couples light hydrocracked naphtha splitter 120 to medium hydrocracked naphtha splitter 130. Production system 100 passes the light hydrocracked naphtha splitter bottoms through light hydrocracked naphtha splitter bottoms line 124 into medium hydrocracked naphtha splitter 130. Medium hydrocracked naphtha splitter 130 is operable to form medium hydrocracked naphtha and heavy hydrocracked naphtha from the introduced light hydrocracked naphtha splitter bottoms. Medium hydrocracked naphtha is useful for gasoline blending with additional treatment. Production system 100 passes medium hydrocracked naphtha from medium hydrocracked naphtha splitter 130 using medium hydrocracked naphtha line 134.

Gasoline blending component production system 100 introduces the straight run naphtha into naphtha hydrotreater 140 (NHT). Light hydrocracked naphtha line 122 couples light hydrocracked naphtha splitter 120 to NHT 140. Production system 100 passes the light hydrocracked naphtha into NHT 140 through light hydrocracked naphtha line 122. Medium hydrocracked naphtha splitter bottoms line 132 couples medium hydrocracked naphtha splitter 130 to NHT 140. Production system 100 passes the heavy hydrocracked naphtha into NHT 140 through medium hydrocracked naphtha splitter bottoms line 132. NHT 140 also receives a hydrogen feed from an external source (not shown).

NHT 140 is operable to hydrotreat the introduced naphtha feeds to saturate any olefins present in the light and heavy hydrocracked naphtha and to desulfurize, denitrify and deoxygenate the heterorganics in the straight run naphtha. The hydrotreated naphtha formed is relatively free of heterorganics and is therefore considered "sweetened".

Production system 100 produces from NHT 140 a sour off gas containing hydrogen sulfide and ammonia using sour off-gas line 142. NHT 140 is also operable to separate the hydrotreated naphtha into "light" hydrotreated naphtha and "heavy" hydrotreated naphtha. Production system 100 passes the sweetened light hydrotreated naphtha from NHT 140 using isomerization feed line 144 and the sweetened heavy hydrotreated naphtha, which contains the majority amount of hydrotreated naphtha, using reformer feed line 146.

Isomerization feed line 144 couples NHT 140 to isomerization unit 150. Production system 100 passes the sweetened light hydrotreated naphtha to isomerization unit 150. Production system 100 also passes a light raffinate from aromatics complex 170 to isomerization unit 150 using aromatics raffinate line 152. Isomerization unit 150 also receives a hydrogen feed from an external source (not shown). Isomerization unit 150 is operable to convert normal paraffins through isomerization into iso-paraffins and aromatics through monoaromatic hydrogenation into naphthenes, forming an isomerate. The isomerate is useful for gasoline blending without additional treatment. Production system 100 produces from isomerization unit 150 an off-gas of unused hydrogen and dealkylated gases using off-gas line 154. Production system 100 passes the isomerate from isomerization unit 150 using isomerate feed line 156.

Reformer feed line 146 couples NHT 140 to continuous catalytic reformer 160 (CCR). Production system 100 passes the sweetened heavy hydrotreated naphtha to CCR 160. CCR 160 is operable to convert the aromatics, paraffins and naphthenes in the sweetened heavy hydrotreated naphtha into a reformate containing aromatics, alkyl aromatics, naphthenes and iso-paraffins through a combination of catalytically driven reactions. The reactions include dehydrogenation of naphthenes, isomerization of paraffins to iso-paraffins, hydrodecyclization of naphthenes, demethylation and hydrocracking. CCR 160 also is operable to break apart any heavy heterorganic compounds into paraffins and sour gases. Production system 100 produces from CCR 160 several overhead lighter-than-pentane products using hydrogen rich gas line 162, fuel gas line 164 and LPG line 166. Production system 100 passes the reformate from CCR 160 using aromatics system feed line 168.

Aromatics system feed line 168 couples CCR 160 to aromatics complex 170. Production system 100 passes the reformate to aromatics complex 170. Aromatics complex 170 is operable to separate the reformate into light reformate and heavy reformate. Aromatics complex 170 is also operable to convert the C8 alkyl aromatics in the heavy reformate preferentially into para-xylene, forming the refined para-xylene product. Production system 100 produces from aromatics complex 170 the para-xylene product using para-xylene product line 112. Aromatics complex 170 is also operable to convert a portion of the refot nate into a refined benzene product. Production system 100 produces from aromatics complex 170 the benzene product using benzene product line 110.

Aromatics complex 170 also forms a heavy C9+ alkyl aromatics and paraffins cut, an "in between" C7s paraffins, aromatics and naphthenes cut, and a lighter paraffins and naphthenes raffinate useful for isomerization from the introduced reformate. The C7s cut and the C9+ cut are both useful for gasoline blending without additional treatment. Production system 100 passes the C7s cut from aromatics complex 170 using C7 feed line 174. Production system 100 passes the C9+ cut from aromatics complex 170 using C9+ feed line 172. Production system 100 passes the light raffinate from aromatics complex 170 using aromatics raffinate line 152.

Several external streams useful for gasoline blending are introduced to gasoline blending component production system 100 via gasoline blending facility 180. Normal butane is introduced into gasoline blending facility 180 via normal butane line 106. MTBE is introduced into gasoline blending facility 180 via MTBE line 108.

Production system 100 passes several useful blending components to gasoline blending faculty 180 for product gasoline production. Production system 100 passes isomerate via isomerate feed line 156, C9+s cut containing alkyl aromatics and paraffins using C9+ feed line 172, C7s cut containing paraffins, aromatics and naphthenes through C7 feed line 174 and medium hydrocracked naphtha from medium hydrocracked naphtha splitter 120 using medium hydrocracked naphtha line 134. Gasoline blending facility 180 is operable to produce using the isomerate, the C9+ cut, the C7s cut, the medium hydrocracked naphtha, the normal butane and the MTBE both a regular (91 RON) gasoline product and a premium (95 RON) gasoline product. Production system 100 produces from gasoline blending faculty 180 the regular (91 RON) gasoline product using regular gasoline line 114. Production system 100 produces from gasoline blending faculty 180 the premium (95 RON) gasoline product using premium gasoline line 116.

Supporting Equipment

Embodiments include many additional standard components or equipment that enables and makes operable the described apparatus, process, method and system. Examples of such standard equipment known to one of ordinary skill in the art includes heat exchanges, pumps, blowers, reboilers, steam generation, condensate handling, membranes, single and multi-stage compressors, separation and fractionation equipment, valves, switches, controllers and pressure-, temperature-, level- and flow-sensing devices.

Operation, control and performance of portions of or entire steps of a process or method can occur through human interaction, pre-programmed computer control and response systems, or combinations thereof.

Method of Using the Gasoline Blending Component Production System

The gasoline blending component production system includes dual naphtha splitters operable in combination to form three hydrocracked naphtha intermediate materials introduced stabilized hydrocracked naphtha. The middle-cut material does not require additional processing or treatment before use as a gasoline blending component.

The stabilized hydrocracked naphtha includes paraffins, aromatics and naphthenes having a carbon count between 4 and 9. The stabilized hydrocracked naphtha contains significant amounts of each of C5, C6, C8 and C9 paraffins and C8 and C9 naphthenes by weight; amounts of each of C7 paraffins, C6 and C7 naphthenes and C8 aromatics by weight; and is substantially free of each of C4 paraffins, C5 naphthenes and C6, C7 and C9 aromatics by weight. The stabilized hydrocracked naphtha does not contain greater than a detectable amount of heterorganic compounds, hydrogen, ammonia or hydrogen sulfide. The stabilized hydrocracked naphtha includes paraffins in a range of from about 50 to about 80 percent by weight, naphthenes from about 20 to about 40 percent by weight, and aromatics in a range of from about 1 to about 5 percent by weight. The stabilized hydrocracked naphtha is substantially free of olefins by weight. The stabilized hydrocracked naphtha has an estimated API in a range of from about 65 to about 75.

An embodiment of the method includes introducing to the gasoline component production system a stabilized hydrocracked naphtha having an amount of C5 paraffins in a range of from about 5 to about 15 percent by weight, an amount of C6 paraffins in a range of from about 5 to about 15 percent by weight, an amount of C7 paraffins in a range of from about 5 to about 15 percent by weight, an amount of C8 paraffins in a range of from about 5 to about 15 percent by weight, an amount of C9 paraffins in a range of from about 5 to about 15 percent by weight, an amount of C7 naphthenes in a range of from about 5 to about 15 percent by weight, an amount of C8 naphthenes in a range of from about 5 to about 15 percent by weight, and an amount of C9 naphthenes in a range of from about 5 to about 15 percent by weight of the stabilized hydrocracked naphtha.

The light hydrocracked naphtha splitter forms a light hydrocracked naphtha from the introduced stabilized hydrocracked naphtha that includes paraffins, aromatics and naphthenes having a carbon count between 4 and 6. The light hydrocracked naphtha contains significant amounts of each of C5 and C6 paraffins by weight, amounts of each of C4 paraffins and C5 naphthenes, and is substantially free of each of C6 aromatics and naphthenes by weight. The amount of light hydrocracked naphtha formed is in a range of from about 10 to about 20 percent by weight of the introduced stabilized hydrocracked naphtha and in a range of from about 0.1 to about 5 percent by weight of the total naphtha passed to the NHT. The light hydrocracked naphtha is useful for isomerization into gasoline blending components.

An embodiment of the method includes operating the gasoline component production system such that the light hydrocracked naphtha formed has an amount of C5 paraffins in a range of from about 75 to about 85 percent by weight and an amount of C6 paraffins in a range of from about 5 to about 15 by weight of the light hydrocracked naphtha.

The medium hydrocracked naphtha splitter forms a heavy hydrocracked naphtha from the remaining introduced hydrocracked naphtha. The heavy hydrocracked naphtha includes paraffins, aromatics and naphthenes having a carbon count between 7 and 9. The heavy hydrocracked naphtha contains significant amounts of each of C8 and C9 paraffins and C8 and C9 naphthenes by weight, an amount of each of C7 naphthenes and C8 and C9 aromatics, and is substantially free of each of C7 paraffins and aromatics. The amount of heavy hydrocracked naphtha formed is in a range of from about 45 to about 55 percent by weight of the introduced stabilized hydrocracked naphtha, in a range of from about 55 to about 65 percent by weight of the light hydrocracked naphtha splitter bottoms processed by the medium hydrocracked naphtha splitter, and in a range of from about 5 to about 15 percent by weight of the total naphtha passed to the NHT. The heavy hydrocracked naphtha is useful for aromatics production after reforming.

An embodiment of the method includes operating the gasoline component production system such that the heavy hydrocracked naphtha formed has an amount of C8 paraffins in a range of from about 15 to about 25 percent by weight, an amount of C9 paraffins in a range of from about 15 to about 25 percent by weight, an amount of C8 naphthenes in a range of about 20 to about 30 percent by weight and an amount of C9 naphthenes in a range of about 20 to about 30 percent by weight of the heavy hydrocracked naphtha.

An embodiment of the method includes the step of operating the gasoline component production system such that the light hydrocracked naphtha and the heavy hydrocracked naphtha combine to form a combined hydrocracked naphtha before passing to the NHT as a feed. The combined hydrocracked naphtha includes paraffins, aromatics and naphthenes having a carbon count between 4 and 9. The combined hydrocracked naphtha includes a significant amount of each of C5, C8 and C9 paraffins and C8 and C9 naphthalenes; amounts of each of C4, C6 and C7 paraffins, C6 naphthalenes, and C8 and C9 aromatics; and is substantially free of each of C7 paraffins, C5 and C6 naphthenes and C6 and C7 aromatics.

Essentially, the combined hydrocracked naphtha is devoid of substantial amounts of C6 and C7 components, which the system directs to gasoline blending as part of the medium hydrocracked naphtha. An embodiment of the method includes operating the gasoline component production system such that the combined hydrocracked naphtha has an amount of C5 paraffins in a range of from about 15 to about 25 percent by weight, an amount of C8 paraffins in a range of from about 10 to about 20 percent by weight, an amount of C9 paraffins in a range of from about 10 to about 20 percent by weight, an amount of C8 naphthalenes in a range of from about 15 to about 25 percent by weight and an amount of C9 naphthenes in a range of from about 15 to about 25 percent by weight of the combined hydrocracked naphtha. The amount of combined hydrocracked naphtha formed is in a range of from about 10 to about 20 percent by weight of the total naphtha passed and introduced to the NHT.

The medium hydrocracked naphtha splitter also forms a medium hydrocracked naphtha from the remaining introduced hydrocracked naphtha. The medium hydrocracked naphtha includes paraffins, aromatics and naphthenes having a carbon count between 5 and 8. The medium hydrocracked naphtha includes significant amounts of each of C6 and C7 paraffins and C6 and C7 naphthalene by weight, contains an amount of each of C8 paraffins and C6 and C7 aromatics by weight, is substantially free of each of C5 paraffins and C5 and C8 naphthenes by weight and does not contain greater than a detectable amount of C8 aromatics by weight. The amount of medium hydrocracked naphtha formed is in a range of from about 25 to about 45 percent by weight of the introduced stabilized hydrocracked naphtha and in a range of from about 35 to about 45 percent by weight of the medium hydrocracked naphtha splitter processed light hydrocracked naphtha splitter bottoms. The medium hydrocracked naphtha is useful for gasoline production without additional treatment.

An embodiment of the method includes operating the gasoline component production system such that the medium hydrocracked naphtha formed has an amount of C6 paraffins in a range of from about 20 to about 30 percent by weight, an amount of C6 naphthenes in a range of from about 15 to about 25 percent by weight, an amount of C7 paraffins in a range of from about 25 to about 35 percent by weight and an amount of C7 naphthenes in a range of from about 20 to about 30 percent by weight of the medium hydrocracked naphtha.

The NHT forms the sweetened light hydrotreated naphtha for use in the isomerization unit. The sweetened light hydrotreated naphtha includes paraffins, aromatics and naphthenes having a carbon count between 4 and 7. The sweetened light hydrotreated naphtha contains significant amounts of each of C5 and C6 paraffins by weight, contains amounts of each of C4 paraffins and C5 and C6 naphthenes by weight, is substantially free of each of C6 aromatics and C7 paraffins by weight and does not contain greater than a detectable amount of C7 aromatics or naphthenes by weight. The amount of sweetened light hydrotreated naphtha formed is in a range of from about 20 to about 25 percent by weight of the total naphtha passed and introduced to the NHT.

An embodiment of the method includes operating the gasoline component production system such that the sweetened light hydrotreated naphtha formed has an amount of C5 paraffins in a range of from about 45 to about 55 percent by weight and an amount of C6 paraffins in a range of from about 35 to about 45 percent by weight of the sweetened light hydrotreated naphtha.

The NHT also forms the sweetened heavy hydrotreated naphtha for use in the CCR unit. The sweetened heavy hydrotreated naphtha includes paraffins, aromatics and naphthenes having a carbon count between 6 and 11. The sweetened light hydrotreated naphtha contains significant amounts of each of C7-9 paraffins and by weight; contains amounts of each of C6 and C10 paraffins, C6-9 naphthenes and C7-9 aromatics by weight; is substantially free of each of C11 paraffins, C10 naphthenes and C6 and C10 aromatics by weight; and does not contain greater than a detectable amount of either C11 naphthenes or aromatics by weight. The amount of sweetened light hydrotreated naphtha formed is in a range of from about 75 to about 80 percent by weight of the total naphtha passed and introduced to the NHT.

An embodiment of the method includes operating the gasoline component production system such that the sweetened heavy hydrotreated naphtha formed has an amount of C7 paraffins in a range of from about 10 to about 20 percent by weight, an amount of C8 paraffins in a range of from about 15 to about 25 percent by weight, an amount of C9 paraffins in a range of from about 10 to about 20 percent by weight and an amount of C8 naphthenes in a range of from about 5 to about 15 percent by weight of the sweetened heavy hydrotreated naphtha.

Gasoline Blending Components

The gasoline blending component production system produces a medium hydrocracked naphtha; an isomerate containing light iso-paraffins and naphthenes; a C7s cut containing alkyl aromatics, naphthenes and paraffins; and a C9+ cut containing alkyl aromatics and paraffins. The medium hydrocracked naphtha, isomerate, the C7s cut and the C9+ cut are all gasoline blending components that do not require any additional treatment.

System Products

The gasoline blending component production system also produces chemical feedstock grades of benzene and paraxylene for use outside of the production system.

The gasoline component production system produces gasoline products with the gasoline blending components and suitable portions of introduced n-butane and MTBE. The gasoline fuel composition that includes the medium hydrocracked naphtha as a component has a RON (Research Octane Number) in a range of from about 91 (regular) to about 95 (premium).

EXAMPLES

Examples of specific embodiments facilitate a better understanding of the gasoline blending component production system and its method of use. In no way should the Examples limit or define the scope of the invention.

Example 1 is a process run of straight run and hydrocracked naphtha using the gasoline blending components production system as shown in FIG. 1 and operable as previously described. Example 1 forms three types of intermediary hydrocracked naphtha—a light hydrocracked naphtha, a medium hydrocracked naphtha and a heavy hydrocracked naphtha—using the coupled light and medium hydrocracked naphtha splitters.

Comparative Example 1 is a process run of straight run naphtha and hydrocracked naphtha uses a comparable gasoline blending components production system having a similar NHT, isomerization, CCR and aromatics complex configuration as the production system used to process Example 1. The difference in configuration and operation of the system of Comparative Example 1 and Example 1 is that for Comparative Example 1 the hydrocracked naphtha is separated into a light hydrocracked naphtha and a heavy hydrocracked naphtha. One of ordinary skill in the art recognizes this as a traditional configuration for handling hydrocracked naphtha in the context of forming gasoline blending components. The Comparative Example 1 system diverts a portion of the heavy hydrocracked naphtha to gasoline blending; the remainder towards the NHT. The Comparative Example 1 system directs all of the light hydrocracked naphtha to the NHT. There are no other system differences between Comparative Example 1 and Example 1.

The term "comparable" means similar or like. To compare the results of the Comparative Example 1 process and the Example 1 process on a "like kind" or similar operating basis, the difference in the mass flow rate between the straight run naphtha feed introduced to the system of Example 1 is within 1% of a compositionally equivalent feed to the Comparative Example 1 system. As well, the difference in the mass flow rate between the hydrocracked naphtha feed introduced to the system of Example 1 is within 1% of a compositionally equivalent feed to the Comparative Example 1 system. All other operational aspects of the two processes are comparable as permitted given the differences in compositions and volumes of the intermediate product streams such that steady state operations are achieved and a fair and reasonable operational performance comparison between the two different systems can be made.

The introduced hydrocracked naphtha feed is a combined stream originating from a hydrocracking unit where the diesel flash point is set to 60° C.

For the comparable process runs, the gasoline production specification is set to "severized". The isomerization unit operates as "once-through" isomerization process. C8 isomerization in the aromatics complex is set for XYMAX isomerization (Exxon Mobil Corporation; Irving, Tex.). The naphtha hydrotreater splitter cut point is set to separate hydrotreated naphtha at "60% benzene precursor". The determination of the amount of premium versus regular gasoline produced is on a linear blending basis.

Tables 1-4 show an analysis of comparable naphtha process runs using the system configurations described for Example 1 and Comparative Example 1. Table 1 shows high-level feed rates, unit throughput for the major process units and system products flow rates. Table 2 shows information on the naphtha feeds, especially the splitting of hydrocracked naphtha before hydrotreatment. Table 3 shows percentage stream outputs based upon feed inputs. Table 4 shows a comparison between total products and kinds of products produced the Comparative Example 1 and Example 1 process runs.

Tables 1-4 show several units of measure. "KTA" is kilotons annually. "BPSD" is barrels per stream day. "Kg/h" is kilograms per hour. "T/h" is tons per hour. "RON" is research octane number, which is a value determinable and understood by one of ordinary skill in the art. "MBD" is thousand barrels per day.

TABLE 1

Table 1: Overall feeds, unit production throughput, and system products from comparative runs Comparative Example 1 and Example 1.

| Material | Units of Measure | Comparative Example 1 | Example 1 |
|---|---|---|---|
| System Feeds | | | |
| Total Naphtha | BPSD | 122498 | 122498 |
| MTBE Import | BPSD | 11362 | 4930 |
| N-Butane Imports | BPSD | 1858 | 748 |
| Total Feeds | BPSD | 135719 | 128176 |
| Unit Throughputs | | | |
| NHT | T/hr | 522 | 537 |
| Isomerization Unit | T/hr | 148 | 157 |
| Reformer Unit | T/hr | 381 | 407 |
| Aromatics Complex | T/hr | 252 | 350 |
| System Products | | | |
| Premium Gasoline | BPSD | 33562 | 29723 |
| Regular Gasoline | BPSD | 62329 | 55200 |
| Total Gasoline Pool | BPSD | 95890 | 84924 |
| Light Hydrotreated Naphtha Export | KTA | 118 | 0 |
| Para-xylenes | KTA | 562 | 819 |
| Benzene | KTA | 188 | 230 |

Table 1 shows a significant elevation in the production value for the Aromatics Complex in Example 1 versus Comparative Example 1. Table 1 also shows an overall decline in total gasoline produced value from the gasoline blending facility and light hydrotreated naphtha export, but a significant increase in para-xylene and a modest increase in benzene production value between Comparative Example 1 and Example 1.

Example 1 does not export hydrotreated light naphtha. The overall volume of lighter material that makes up the material exported in Comparative Example 1—lighter C5/6 naphthenes and C6/7 paraffins—Example 1 directs to the gasoline pool via the medium hydrocracked naphtha.

TABLE 2

Table 2: Straight run and hydrocracked naphtha splits to NHT and gasoline blending facility for Comparative Example 1 and Example 1.

| Naphtha Streams | Units of Measure | Comparative Example 1 | Example 1 |
|---|---|---|---|
| Straight Run Naphtha to NHT | kg/hr | 451610 | 451610 |
| Hydrocracked Light Naphtha to NHT | kg/hr | 40018 | |
| Hydrocracked Light + Heavy Naphtha to NHT | kg/hr | | 84850 |
| Hydrocracked Medium Naphtha to Gas Pool | kg/hr | | 41208 |
| Total Hydrocracked Heavy Naphtha | kg/hr | 86040 | |
| Portion of Total Hydrocracked Heavy Naphtha to Gas Pool | kg/hr | 51449 | |
| Portion of Total Hydrocracked Heavy Naphtha to NHT | kg/hr | 34591 | |
| Total Naphtha Feed | kg/hr | 577668 | 577668 |

Table 2 shows that in the system of Example 1 routes medium hydrocracked naphtha to the gasoline blending facility. The system of Comparative Example 1 directs light hydrocracked naphtha and a portion of the heavy hydrocracked naphtha to the NHT.

TABLE 3

Table 3: Total product stream volume percents based upon inputs into production units for Comparative Example 1 and Example 1.

| Product Streams (vol. % of total introduced) | Comparative Example 1 | Example 1 |
|---|---|---|
| NHT | | |
| Sour Off-gas | 0.53 | 0.53 |
| NHT Splitter Feed | 99.47 | 99.47 |
| Light Hydrotreated Naphtha from NHT Splitter | 26.5 | 23.8 |
| Heavy Hydrotreated Naphtha from NHT Splitter | 73.5 | 76.2 |
| Isomerization Unit | | |
| Off Gas | 1.36 | 1.32 |
| Isomerate | 98.64 | 98.68 |
| CCR | | |
| H2 Rich Gass | 7.79 | 7.48 |
| Fuel Gas | 1.44 | 1.25 |
| LPG | 6.12 | 5.25 |
| Reformate | 84.65 | 86.02 |
| Aromatics Complex | | |
| Fuel Gas | 1.56 | 1.73 |
| Para-xylene | 25.93 | 27.22 |
| Benzene | 8.66 | 7.64 |
| Raffinate | 14.68 | 13.45 |
| C7s | 19.75 | 18.08 |
| C9+ | 29.42 | 31.88 |

Table 3 shows that with the hydrocracked naphtha split adjustment between Comparative Example 1 and Example 1 that the overall stream volumes have not changed significantly. It is notable that the para-xylene product and the C9+ cut to the gasoline blending facility both increase while benzene production declines in Example 1 versus Comparative Example 1 as a percentage of the feed to the aromatics complex.

TABLE 4

Table 4: Total production between Comparative Example 1 and Example 1.

| Product | Units of Measure | Comparative Example 1 | Example 1 | Δ |
|---|---|---|---|---|
| Total Gasoline | MBD | 96.4 | 85.0 | −11.8% |
| Benzene | MBD | 3.6 | 4.4 | 22.2% |
| Para-xylene | MBD | 11.7 | 18.0 | 53.8% |

Comparing the volume percent of benzene as part of the product stream versus the amount shown as produced in Table 4, it is evident that the percentages of Table 3 for the aromatics complex is based upon a much larger input stream volume for Example 1 versus Comparative Example 1. The process of Example 1 significantly increases aromatics production throughput by fully diverting the heavy portion of the introduced hydrocracked naphtha versus splitting its volume.

Table 4 shows that the decline in total gasoline production on a volume basis is offset by significant gains in benzene and para-xylene production such that Example 1 makes several MBD more barrels of product per day than Comparative Example 1. On a barrel versus barrel basis financially, however, barrels of benzene and para-xylene are commercially more valuable than a barrel of motor fuel. Benzene and para-xylene have global commodity markets that increase their value tremendously whereas gasoline tends to be regional.

What is claimed is:

1. A method for producing gasoline blending components while maximizing aromatic production using naphtha, the method comprising the steps of:

introducing stabilized hydrocracked naphtha to a light hydrocracked naphtha splitter of a gasoline blending components production system;

introducing straight run naphtha to a naphtha hydrotreater (NHT) of the gasoline blending components production system;

operating the gasoline blending components production system such that the light hydrocracked naphtha splitter forms both a light hydrocracked naphtha and a light hydrocracked naphtha splitter bottoms from the stabilized hydrocracked naphtha, the light hydrocracked naphtha passes into the NHT and the light hydrocracked naphtha splitter bottoms passes into a medium hydrocracked naphtha splitter, the medium hydrocracked naphtha splitter forms both a medium hydrocracked naphtha and a heavy hydrocracked naphtha from the light hydrocracked naphtha splitter bottoms, where the medium hydrocracked naphtha product is useful for gasoline blending without additional treatment, the heavy hydrocracked naphtha passes into the NHT, and an isomerate, a benzene product, a para-xylene product, a C7s cut and a C9+ cut form from the introduced straight run naphtha, the light hydrocracked naphtha and the heavy hydrocracked naphtha, where the isomerate, the C7s cut, and the C9+ cut are useful for gasoline blending without additional treatment, where the gasoline blending components production system includes:

the light hydrocracked naphtha splitter that is operable to produce a light hydrocracked naphtha and a light hydrocracked naphtha splitter bottoms from the received stabilized hydrocracked naphtha;

the medium hydrocracked naphtha splitter that couples to the light hydrocracked naphtha splitter and that is operable to produce a medium hydrocracked naphtha product and a heavy hydrocracked naphtha from the received light hydrocracked naphtha splitter bottoms;

the naphtha hydrotreater (NHT) that couples to both the light hydrocracked naphtha splitter and the medium hydrocracked naphtha splitter and that is operable to hydrotreat a naphtha feed for producing and separating a sweetened light hydrotreated naphtha and a sweetened heavy hydrotreated naphtha from the received straight run naphtha, the light hydrocracked naphtha and the heavy hydrocracked naphtha;

an isomerization unit that couples to both the NHT and an aromatics complex operable to produce a refined benzene product, a refined para-xylene product, a C7s cut product, a C9+ cut product and a raffinate and that is operable to produce an isomerate from the received sweetened light hydrotreated naphtha and the raffinate;

a continuous catalytic reformer (CCR) that couples to the NHT and that is operable to produce a reformate from the received sweetened heavy hydrotreated naphtha using one or more processes selected from naphthene dehydrogenation, naphthene hydrodecyclization, paraffin isomerization, demethylation and hydrocracking from the received sweetened heavy hydrotreated naphtha; and the aromatics complex that couples to the CCR.

2. The method of claim 1 where the introduced stabilized hydrocracked naphtha comprises 50 to 80 percent by weight of C6, C8 and C9 paraffins, 20 to 40 percent by weight of C8 and C9 naphthenes, less than 1 percent by weight of each of C4 paraffins and C6, C7 and C9 aromatics, and does not contain greater than a detectable amount of heterorganic compounds, hydrogen, methane, ethane, propane, ammonia or hydrogen sulfide by weight of the introduced stabilized hydrocracked naphtha.

3. The method of claim 1 where the gasoline blending components production system operates the light hydrocracked naphtha splitter such that the light hydrocracked naphtha produced comprises 75 to 85 percent by weight of C5 paraffins, 5 to 15 percent by weight of C6 paraffins, less than 1 percent by weight of each of C6 aromatics and naphthenes, and does not contain greater than a detectable amount of heavier than C6 aromatics, naphthenes or paraffins by weight of the light hydrocracked naphtha.

4. The method of claim 1 where the gasoline blending components production system operates the medium hydrocracked naphtha splitter such that the heavy hydrocracked naphtha produced comprises 15 to about 25 percent by weight of each of C8 and C9 paraffins and 20 to about 30 percent by weight of C8 and C9 naphthenes, less than 1 percent by weight of each of both C7 paraffins and aromatics, and does not contain greater than a detectable amount of lighter than C7 aromatics, naphthenes or paraffins by weight of the heavy hydrocracked naphtha.

5. The method of claim 1 where the gasoline blending components production system operates the medium hydrocracked naphtha splitter such that the medium hydrocracked naphtha produced includes paraffins, aromatics and naphthenes having a carbon count between 5 and 8, comprises 20 to 30 percent by weight of C6 paraffins, 25 to 35 percent by weight of C7 paraffins, 20 to 30 percent by weight of C7 naphthenes, less than 1 percent by weight of each of C5 paraffins and C5 and C8 naphthenes by weight, and does not contain greater than a detectable amount of C8 aromatics by weight of the medium hydrocracked naphtha product.

6. The method of claim 1 where the gasoline blending components production system operates the light hydrocracked naphtha splitter and the medium hydrocracked naphtha splitter such that the amount of light hydrocracked naphtha produced from the light hydrocracked naphtha splitter is in a range of from about 10 to about 20 percent by weight, the amount of the heavy hydrocracked naphtha produced from the medium hydrocracked naphtha splitter is in a range of from about 45 to about 55 percent by weight, and the amount of the medium hydrocracked naphtha product produced by the medium hydrocracked naphtha splitter is in a range of from about 25 to about 45 percent by weight of the introduced stabilized hydrocracked naphtha.

7. The method of claim 1 where the gasoline blending components production system further operates to combine the light hydrocracked naphtha and the heavy hydrocracked naphtha into a combined hydrocracked naphtha and to pass the combined hydrocracked naphtha to the NHT such that the combined hydrocracked naphtha includes paraffins in a range of from 50 to 80 percent, aromatics in a range of from 1 to 5 percent by weight and naphthenes in a range of from 20 to 40 percent by weight having a carbon count between 4 and 9, and less than 1 percent by weight of each of C5 and C6 naphthenes, C6 and C7 aromatics and C7 paraffins.

8. A method for manufacturing a gasoline fuel composition, the manufacturing method comprising the steps of:

introducing stabilized hydrocracked naphtha and straight run naphtha to a gasoline blending components production system;

operating the gasoline blending components production system to produce a medium hydrocracked naphtha, a isomerate, a C7s cut, and a C9+ cut from the introduced stabilized hydrocracked naphtha and straight run naphtha;

introducing normal butane and methyl tert-butyl ether to the gasoline blending components production system; and blending proportional amounts of the medium hydrocracked naphtha, the isomerate, the C7s cut, the C9+ cut, the normal butane and the methyl tert-butyl ether to form the gasoline fuel composition;

where the gasoline fuel composition has a Research Octane Number in a range of from about 91 to about 95, and where the medium hydrocracked naphtha includes paraffins, aromatics and naphthenes having a carbon count between 5 and 8, comprises 20 to 30 percent by weight of C6 paraffins, 25 to 35 percent by weight of C7 paraffins, 20 to 30 percent by weight of C7 naphthenes, less than 1 percent by weight of each of C5 paraffins and C5 and C8 naphthenes by weight, and does not contain greater than a detectable amount of C8 aromatics by weight of the medium hydrocracked naphtha product.

9. The method of claim 8 where the introduced stabilized hydrocracked naphtha comprises 5 to 15 percent by weight of each of C6, C8 and C9 paraffins and C8 and C9 naphthenes, less than 1 percent by weight of each of C4 paraffins and C6, C7 and C9 aromatics, and does not contain greater than a detectable amount of heterorganic compounds, hydrogen, methane, ethane, propane, ammonia or hydrogen sulfide by weight of the introduced stabilized hydrocracked naphtha.

10. The method of claim 8 where the medium hydrocracked naphtha comprises C6 paraffins in a range of from about 20 to about 30 percent by weight, C6 naphthenes in a range of about 15 to about 25 percent by weight, C7 paraffins in a range of about 20 to about 30 percent by weight, and C7 naphthenes in a range of about 20 to about 30 percent by weight.

11. The method of claim 8 where the amount of the medium hydrocracked naphtha produced is in a range of from about 25 to about 45 percent of the amount of introduced stabilized hydro cracked naphtha.

12. The method of claim 8 where the gasoline blending components production system also produces a refined benzene product and a refined para-xylene product.

13. A gasoline blending components production system useful for producing aromatics and gasoline blending components from naphtha, the production system comprising:

a light hydrocracked naphtha splitter that is operable to receive a stabilized hydrocracked naphtha and to produce a light hydrocracked naphtha and a light hydrocracked naphtha splitter bottoms;

a medium hydrocracked naphtha splitter that fluidly couples to the light hydrocracked naphtha splitter and that is operable to receive the light hydrocracked naphtha splitter bottoms and to produce a medium hydrocracked naphtha and a heavy hydrocracked naphtha;

a naphtha hydrotreater (NHT) that fluidly couples to both the light hydrocracked naphtha splitter and the medium hydrocracked naphtha splitter and that is operable to receive a straight run naphtha, the light hydrocracked naphtha and the heavy hydrocracked naphtha and to produce a sweetened light hydrotreated naphtha and a sweetened heavy hydrotreated naphtha;

an isomerization unit that fluidly couples to both the NHT and an aromatics complex operable to produce a refined benzene product, a refined para-xylene product, a C7s cut product, a C9+ cut product and that is operable to receive the sweetened light hydrotreated naphtha and a raffinate and to produce an isomerate;

a continuous catalytic reformer (CCR) that fluidly couples to the naphtha hydrotreater and that is operable to receive the sweetened heavy hydrotreated naphtha and to produce a reformate; and the aromatics complex that fluidly couples to the CCR and that is operable to receive the reformate;

where the medium hydrocracked naphtha, the isomerate, the C7s cut, and the C9+ cut are useful as gasoline blending components without additional treatment.

14. The method of claim 1, wherein the naphtha hydrotreater (NHT) is operable to hydrotreat a naphtha feed via olefin saturation, desulfurization, denitrification, deoxygenation and combinations thereof.

15. The method of claim 1, wherein the sweetened light hydrotreated naphtha and a sweetened heavy hydrotreated naphtha are relatively free of heterorganics.

* * * * *